US007249479B2

(12) United States Patent
Burger

(10) Patent No.: US 7,249,479 B2
(45) Date of Patent: Jul. 31, 2007

(54) DEVICE FOR FORMING THIN-WALLED MATERIAL INTO A SLEEVE-SHAPED BODY

(75) Inventor: Manuel Burger, Nesselwang (DE)

(73) Assignee: Felss Burger GmbH, Nesselwang (DE)

( * ) Notice: Subject to any disclaimer, the term of this patent is extended or adjusted under 35 U.S.C. 154(b) by 21 days.

(21) Appl. No.: 10/489,227

(22) PCT Filed: Aug. 26, 2002

(86) PCT No.: PCT/EP02/09503

§ 371 (c)(1),
(2), (4) Date: Aug. 16, 2004

(87) PCT Pub. No.: WO03/022479

PCT Pub. Date: Mar. 20, 2003

(65) Prior Publication Data

US 2005/0005662 A1 Jan. 13, 2005

(30) Foreign Application Priority Data

Sep. 10, 2001 (DE) ..... 101 44 465

(51) Int. Cl.
*B21D 51/28* (2006.01)

(52) U.S. Cl. ..... 72/51; 72/389.8; 72/387

(58) Field of Classification Search ..... 72/51, 72/373, 379.2, 389.8, 367.1, 370.04, 387, 72/368

See application file for complete search history.

(56) References Cited

U.S. PATENT DOCUMENTS

| | | | | |
|---|---|---|---|---|
| 737,989 | A * | 9/1903 | Wolfe | 72/51 |
| 3,899,913 | A * | 8/1975 | Schlosser et al. | 72/383 |
| 5,365,766 | A * | 11/1994 | Takahashi et al. | 72/387 |

FOREIGN PATENT DOCUMENTS

| | | |
|---|---|---|
| DE | 870540 | 3/1953 |
| DE | 73 24 077 | 9/1973 |
| DE | 197 43 436 | 4/1999 |
| FR | 1209505 | 3/1960 |
| GB | 2350575 | 12/2000 |

* cited by examiner

*Primary Examiner*—Dmitry Suhol
(74) *Attorney, Agent, or Firm*—Collard & Roe, P.C.

(57) ABSTRACT

Apparatus (1) for forming thin-walled material from an essentially flat piece of material (2) into a sleeve-like body (20), with two forming dies (3, 4), at least one of which is configured to be able to move into position against the other one and at least one of the forming dies (3, 4) is pivoted, while the clearance between the two forming dies (3, 4) when they are open is so large that the flat piece of material (2) can be placed between the two forming dies.

5 Claims, 2 Drawing Sheets

DEVICE FOR FORMING THIN-WALLED MATERIAL INTO A SLEEVE-SHAPED BODY

CROSS REFERENCE TO RELATED APPLICATIONS

Figure 1:
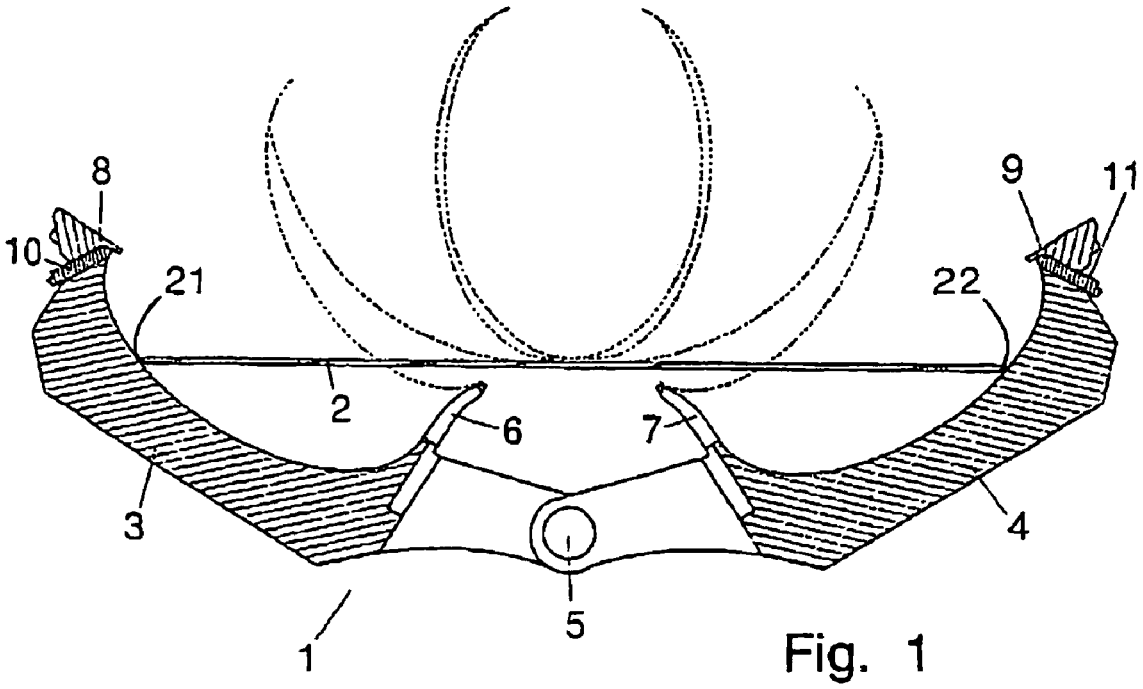

Applicant claims priority under 35 U.S.C. §119 of German Application No. 101 44 465.6 filed on Sep. 10, 2001. Applicant also claims priority under 35 U.S.C. §365 of PCT/EP02/09503 filed on Aug. 26, 2002. The international application under PCT article 21(2) was not published in English.

The invention relates to an apparatus for forming thin-walled material from an essentially flat piece of material into a sleeve-like body, with two forming dies, at least one of which is configured to be able to move into position against the other one.

When sheet metal is being formed into a round or oval body, the flat sheet metal or similar material is generally rolled first before the process of forming it into a finished body in a mould continues.

DE 197 43 436, for example, discloses such an apparatus, which is very suitable for forming large numbers of objects.

The purpose of the invention is to design an apparatus of the kind outlined above in such a way that the forming process can be carried out in a single operation.

In the solution to this problem proposed by the invention, at least one of the forming dies is pivoted, while the clearance between centering elements of the two forming dies when the forming dies are open is so large that the flat piece of material can be placed between the centering elements.

When one or both forming dies are moved towards each other, the sheet metal that has been placed between them is bent into the mould that is formed and takes on the shape specified by the two forming dies when the latter have closed completely.

It is possible in this context to design the apparatus to be extremely simple with largely manual operation, which is very advantageous for short series in particular. Configuration for a fully automatic process is, however, also possible.

Fingers that engage between each other are provided at the end of each of the two forming dies facing the fulcrum of the forming dies.

The plate can rest against these fingers during the bending operation, although the two forming dies are not yet resting against each other. This therefore makes it impossible for the sheet metal to escape into the free space below the forming dies.

Centering elements are located at the end of each of the two forming dies facing away from the fulcrum.

The ends of the sheet metal rest against those centering elements during the forming process, so that the seam of the body that forms is fixed in the position specified by the centering elements.

This makes it simple to close this seam by means of welding.

In a very advantageous development of the invention, the centering elements are pivoted.

This means that each of the two centering elements can be swivelled out of the mould and that the two forming dies can be swivelled together into their final position, in which the body receives its final shape.

It is very advantageous in this context if in accordance with another further development of the invention the centering elements are pivoted on a two-arm lever, the lever arm of which that is facing away from the centering elements is engaged by a cam.

This makes it particularly easy to carry out the swivelling operation of the two centering elements.

In another advantageous further development of the invention, a removable closure element is provided, preferably next to the centering elements.

Following completion of the forming operation, the two closure elements are removed from the forming dies, as a result of which an open gap is created, through which the welded seam to close the body can be produced.

It has proved to be particularly favorable in this context if in accordance with another further development of the invention the closure elements are provided to permit longitudinal movement.

This longitudinal movement can be made particularly easily.

Figure 2:
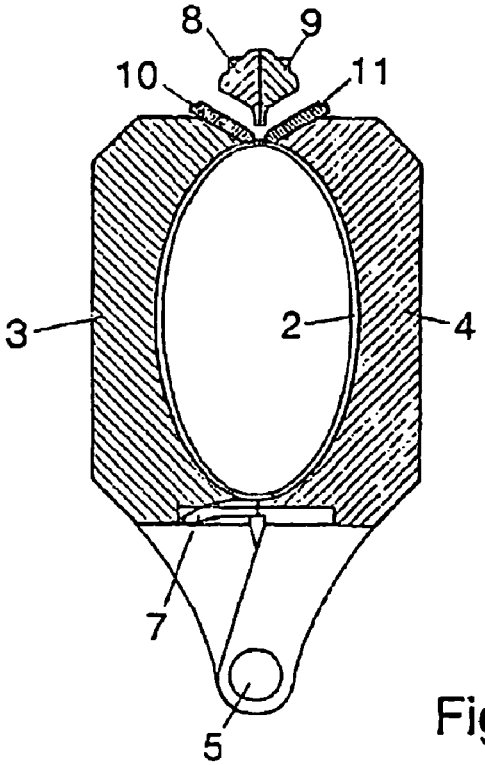
Figure 3:
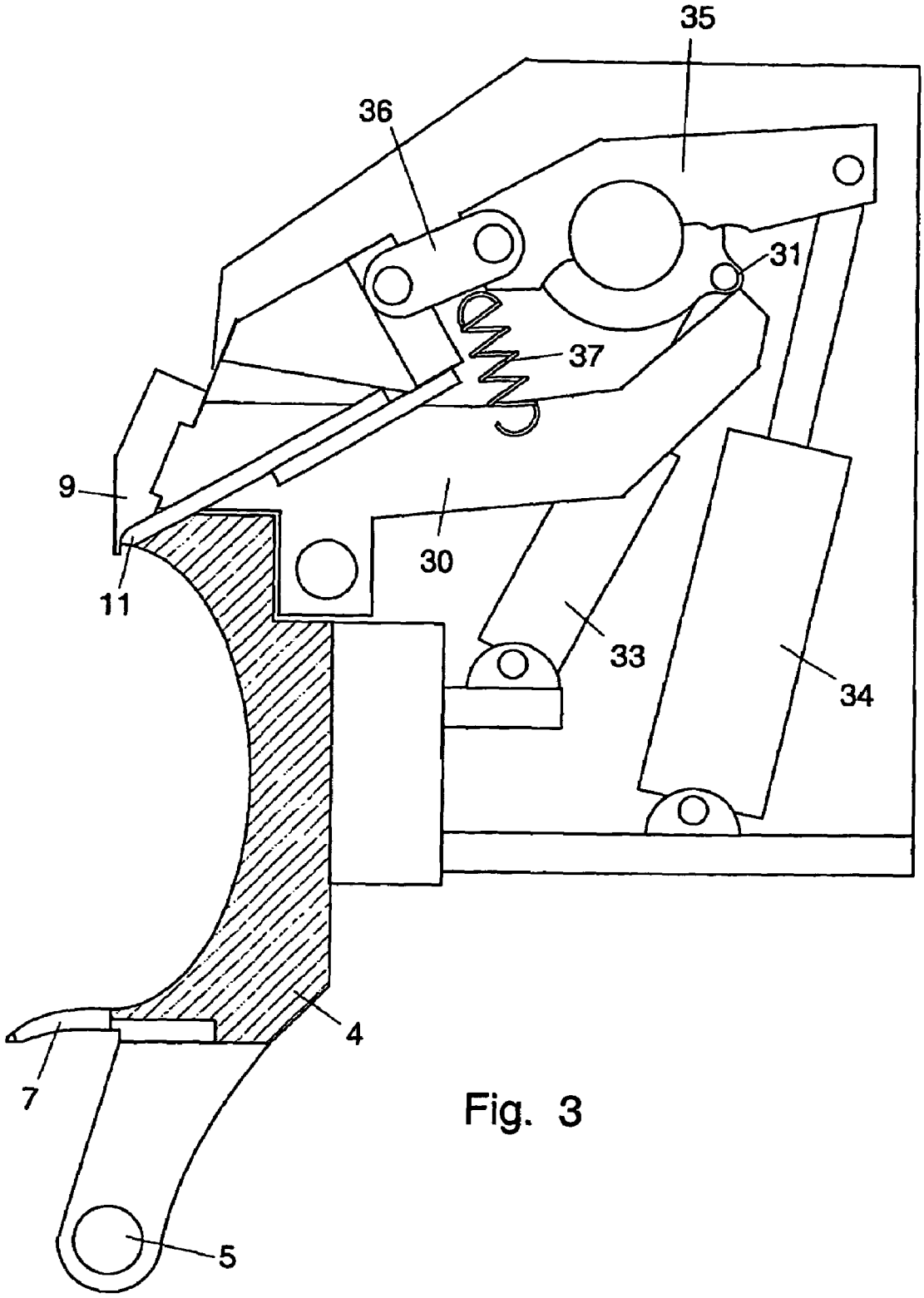

One embodiment of the invention is illustrated in the drawings:

FIG. 1 is a diagrammatic cross section of a forming apparatus with two forming dies in their open position, FIG. 2 shows the forming apparatus illustrated in FIG. 1 in its almost completely closed position and FIG. 3 shows a detail of a forming die on a larger scale.

1 in FIG. 1 is an apparatus that is used to form a sheet metal plate 2 into a body 20. The apparatus 1 includes two forming dies 3 and 4, the hollow shape of which corresponds to the outside shape of the body 20 when it is formed later on. The two forming dies 3, 4 are pivoted around a common fulcrum 5, while it is perfectly possible to pivot only one of the two forming dies and to configure the other one so that it is in a fixed Position. Each of the two forming dies 3, 4 is equipped at its end facing the fulcrum 5 with several fingers 6 and 7, which engage between each other when the two forming dies swivel towards each other. Centering elements 8 and 9, which support the relevant end of the sheet metal plate 2, are provided at the top end of the two forming dies 3, 4. When the two forming dies 3, 4 swivel together, the front faces 21, 22 of the relevant ends of the sheet metal plate 2 move against those centering elements 8 and 9 and the sheet metal plate 2 is bent into the shape of the die as is indicated in FIG. 1. In this context, the fingers 6 and 7 prevent the central section of the sheet metal plate 2 from being able to escape downwards while the bottom ends of the two forming dies are not yet resting against each other. As soon as the two forming dies have been closed to such an extent that the centering elements rest against each other, the latter are pulled out upwards and the two forming dies-are moved into position so that they are resting against each other completely. The two ends of the sheet metal plate 2 then rest against each other without a gap between them. A closure element 10 and 11 is provided directly next to each of the two centering elements 8, 9 and can also be removed once the centering elements have been removed and the two forming dies have closed completely. When these two closure elements 10, 11 are pulled out, a gap 12 is created in the mould produced by the forming dies, through which the two ends of the body 20 can be welded to each other.

In FIG. 2, the apparatus 1 is shown almost completely closed after the centering elements 8, 9 and the closure elements 10, 11 have been removed.

FIG. 3 shows the top section of a forming die 4 with the centering element 9 provided in it and the closure section 11 on a larger scale.

The centering element 9 is attached to a pivoted lever 30, which is actuated by a cam 31 that is pivoted on a rotating disc 32. A piston 33 engages this cam 31, which produces the rotary movement of the disc 32 and thus the swivelling movement of the lever 30.

Another piston 34 engages the closure element 11 via several levers 35 and 36 and moves this closure element 11 from its closed position to its open position and vice-versa.

As is indicated, a spring 37 can also engage the lever 30 of the centering element and move the lever into the engaged position of the centering element.

The invention claimed is:

1. Apparatus (1) for forming thin-walled material from an essentially flat piece of material (2) into a sleeve-like body (20), with two forming dies (3, 4), at least one of which is configured to be able to move into position against the other one, wherein at least one of the forming dies (3, 4) is pivoted around a fulcrum (5) of the forming dies (3, 4) and wherein each of the forming dies (3, 4) has an end facing the fulcrum (5) and an end facing away from the fulcrum (5) of the forming dies (3, 4), with fingers (6, 7) which engage between each other and which are provided at the end of each of the two forming dies (3, 4) facing the fulcrum (5) of the forming dies (3, 4) and with centering elements (8, 9) which are located at the end of each of the two forming dies (3, 4) facing away from the fulcrum (5) of the forming dies (3, 4), wherein the clearance between the centering elements (8, 9), when the forming dies (3, 4) are open, is so large that the clearance accommodates the flat piece of material (2) to be formed between the centering elements (8, 9) and wherein during the forming process, when the at least one of the forming dies (3, 4) is pivoted around the fulcrum (5) of the forming dies (3, 4), front faces (21, 22) of the relevant ends of the piece of material (2) facing away from the fulcrum (5) of the forming dies (3, 4) rest against the centering elements (8, 9), which thereby specify and fix the position of the seam of the body that forms.

2. Apparatus according to claim 1, wherein the centering elements (8, 9) are pivoted.

3. Apparatus according to claim 2, wherein the centering elements (8, 9) are pivoted on a two-arm lever (30), the lever arm of which that is facing away from the centering element (8, 9) being engaged by a cam (31, 32).

4. Apparatus according to claim 1, wherein a removable closure element (10, 11) is provided, preferably next to the centering elements (8, 9).

5. Apparatus according to claim 4, wherein the closure element (10, 11) is provided to permit longitudinal movement.

* * * * *